US009816229B2

(12) United States Patent
Bjornvall et al.

(10) Patent No.: US 9,816,229 B2
(45) Date of Patent: Nov. 14, 2017

(54) BIN ARRANGEMENT FOR THE COLLECTING AND DISCHARGING OF SMALLER LIGNO-CELLULOSIC MATERIAL

(71) Applicant: Valmet AB, Sundsvall (SE)

(72) Inventors: Patrik Bjornvall, Skoghall (SE); Henrik Ransjo, Hammaro (SE); Magnus Wilhelmsson, Skoghall (SE); Jonas Saetherasen, Hammaro (SE)

(73) Assignee: VALMET AB, Sundsvall (SE)

( * ) Notice: Subject to any disclaimer, the term of this patent is extended or adjusted under 35 U.S.C. 154(b) by 0 days.

(21) Appl. No.: 14/776,213

(22) PCT Filed: Mar. 14, 2014

(86) PCT No.: PCT/SE2014/050317

§ 371 (c)(1),
(2) Date: Sep. 14, 2015

(87) PCT Pub. No.: WO2014/142743

PCT Pub. Date: Sep. 18, 2014

(65) Prior Publication Data

US 2016/0040355 A1 Feb. 11, 2016

(30) Foreign Application Priority Data

Mar. 15, 2013 (WO) ..... PCT/SE2013/050284

(51) Int. Cl.
*B65D 88/28* (2006.01)
*D21C 7/08* (2006.01)
(Continued)

(52) U.S. Cl.
CPC ..... *D21C 7/08* (2013.01); *B65D 88/28* (2013.01); *B65D 88/68* (2013.01); *D21C 7/02* (2013.01); *D21C 7/06* (2013.01); *D21D 5/28* (2013.01)

(58) Field of Classification Search
CPC ... D21C 7/08; D21C 7/02; D21C 7/06; B65D 88/28; B65D 88/68; A01C 7/12
(Continued)

(56) References Cited

U.S. PATENT DOCUMENTS 250,976 A * 12/1881 Riedel ..... A01C 15/16 222/281
1,288,025 A * 12/1918 Kennedy ..... A23G 1/206 222/280
(Continued)

FOREIGN PATENT DOCUMENTS

DE 202008001800 4/2008
SE WO03035971 5/2003
(Continued)

OTHER PUBLICATIONS

Chemical Pulping, Book 6A, Gullichsen, J. Fogelholm, C-J, 2000 Fapet Oy, p. 522-523, ISBN 952-5216-06-3 "Chip metering and feeding into process pressure".

*Primary Examiner* — Charles P Cheyney
(74) *Attorney, Agent, or Firm* — Fasth Law Offices; Rolf Fasth

(57) ABSTRACT

The bin arrangement is for collecting and discharging smaller ligno-cellulosic material. The bin has a transition part from a circular section of the bin and downwardly to a rectangular section with a long and short side of the rectangular section. The transition part could be built with few wall segments, thus needing less welding. Two rotary pocket feeders, each with at least one shaft extending parallel to the long side, are arranged directly under the rectangular section, enabling a uniform feed from the bin. The use of two rotary pocket feeders with this design directly under the bin does not destroy the even feed of material through the bin part, which otherwise is experienced from using conventional feed screws that feed material in a transverse direction
(Continued)

from the bin outlet. The bin does not need to have a complex bin design which converges to a small circular inlet to a conventional rotary pocket feeder.

11 Claims, 4 Drawing Sheets

(51) Int. Cl.
*B65D 88/68* (2006.01)
*D21C 7/02* (2006.01)
*D21C 7/06* (2006.01)
*D21D 5/28* (2006.01)

(58) Field of Classification Search
USPC .... 222/412, 238, 280, 281, 367–370, 185.1, 222/411, 462, 413; 366/300
See application file for complete search history.

(56) References Cited

U.S. PATENT DOCUMENTS 1,492,271 A * 4/1924 Snyder ..... B01F 15/0201 222/134
2,778,482 A * 1/1957 Lasch ..... B65G 33/00 198/560
2,816,694 A * 12/1957 Douglass, Jr. ..... F23G 7/105 222/346
2,943,752 A 7/1960 Platt
3,921,351 A * 11/1975 Johnson ..... B65D 88/28 222/462
4,593,612 A * 6/1986 Rieger ..... B01F 15/068 366/144
4,605,309 A * 8/1986 Albers ..... B29B 7/564 366/300
4,776,497 A * 10/1988 Hayashi ..... B30B 15/302 222/235
4,804,111 A * 2/1989 Ricciardi ..... G01G 13/22 177/116
5,709,322 A * 1/1998 Ricciardi ..... G01F 13/005 222/227
6,199,299 B1 3/2001 Prough
6,623,156 B1 * 9/2003 Meinander ..... B01F 7/085 162/57
7,178,698 B2 * 2/2007 Forslund ..... B65G 33/10 222/185.1
9,522,778 B2 * 12/2016 Southwell ..... B65D 88/28
2003/0131891 A1 * 7/2003 Sinur ..... F16K 15/03 137/527.8
2005/0121469 A1 6/2005 Landers

FOREIGN PATENT DOCUMENTS

WO WO9521287 8/1995
WO WO9819957 5/1998

* cited by examiner

BIN ARRANGEMENT FOR THE COLLECTING AND DISCHARGING OF SMALLER LIGNO-CELLULOSIC MATERIAL

PRIOR APPLICATOIN

This application is a U.S. national phase application based on International Application No. PCT/SE2014/050317, filed Mar. 14, 2014 that claims priority from PCT/SE2013/050284, filed 15 Mar. 2013.

TECHNICAL FIELD

The present invention relates to a bin arrangement for the collecting and discharging of smaller ligno-cellulosic material, preferably in the form of chips.

BACKGROUND OF THE INVENTION

In connection with the manufacture of papermaking pulp, various steps in the process include material being transported in the form of chips or pulp. In certain parts of the process the material must be fed uniformly from bins for storage and/or treatment of the material to a subsequent treatment step. The problem in this case is to bring about a uniform flow through the bin. The material can adhere to the walls of the bin and thereby cause arching and/or ratholing and/or the material can move at different speeds in different parts of the cross-section of the bin. The feed of the material through the bin can thus be stopped, or the retention time of the material in the bin can vary. This is particularly unfavourable when the material is subjected to some kind of treatment in the bin, for example preheating with steam or treatment with chemicals. In this case it is wished that the treatment is made during a predetermined time, which is difficult if different parts of the material move in different ways.

Many different solutions of the above problem have been suggested.

U.S. Pat. No. 2,943,752 from 1960 disclose an early chip bin design for bulk feed with a rectangular lower outlet with a transition part down to the lower outlet that promote an even flow through the chip bin as such. This chip bin avoids the extensive welding work necessary to make the transition part. However, directly at the outlet end there is still a single screw feeding the bulk material sidewise, which screw hinders even flow out from the bin as the screw is filled primarily at the distant end as seen from the outlet.

EP 0 742 854 discloses among others a similar solution, but with one screw. Hence, the same problem with filling the screw from the end of the screws is at hand.

U.S. Pat. No. 4,958,741 discloses a bin with an upper part having a circular upper edge and an oval lower edge, where the length of the oval is equal to the diameter of the circle, and with a lower part having an oval upper edge and a circular lower edge. This chip bin is expensive to manufacture as a lot of welding work is necessary for each of the wall segments making up the chip bin convergence.

U.S. Pat. No. 6,336,573 discloses a bin with a cylindrical upper part and a lower part with an upper circular edge and a lower oval edge, where the length of the oval is equal to the diameter of the circle. Feeding out from the bin is made with a screw. Several proposals are mentioned addressing the problem with filling the screw evenly from the whole chip bin, and thus trying to decrease the disadvantages with using a screw. The proposals includes varying shaft diameter, flight diameter and varying pitch of the screw so as to provide a substantial uniform flow along the slot outlet.

SE 511 519 (=U.S. Pat. No. 6,250,514) and U.S. Pat. No. 6,089,417 shows more complicated solutions of bins per se resulting in a chip bin that is expensive to manufacture as a lot of welding work is necessary for each of the wall segments making up the chip bin convergence.

U.S. Pat. No. 7,178,698 discloses a bin with an upper cylindrical part and a lower part having a circular upper edge and a rectangular lower edge, where the length of the long side of the rectangle is equal to the diameter of the circle. Feeding out from the bin is made with two counter rotating screws, feeding towards a central circular outlet beneath the screws. However, the problem is that the screws are filled at the end of the screws emptying the chip bin from there, and at the central outlet the screw may not empty the bin in equal volume from the centre of the bin as the screw is already filled.

The problem with all these chips bins lies in the usage of screw conveyers that pick up bulk material close at wall of chip bin outlet and thus empties the chip bin from that end of screw, but not promoting an even flow through the entire chip bin volume. Even if the bin design per se is promoting even flow downwards, the screw conveyers prevents even flow as they are filled at the distant end as seen from the subsequent outlet.

In following description is the expression rotary pocket feeder used which is a conventional machine per se in feeding wood chips to a digester. Another name for the rotary pocket feeder is the star feeder. In a rotary pocket feeder are a number of pockets formed between axially oriented vanes on a revolving shaft, feeding comminuted material, for example chips from an upper inlet end to a lower outlet end after a rotation of about 180 degrees. The pockets are simply filled by gravity, and are emptied by gravity. Rotary pocket feeders have been used in conventional piping for feeding chips to digesters. In conventional continuous cooking systems has one rotary pocket feeder, i.e. chip meter, been used for chip volume measurements after the chip bin and a following rotary pocket feeder, i.e. low pressure feeder, has been used as a low pressure sluice feeder ahead of the steaming vessel. These rotary feeders are described more in detail in *Chemical Pulping* Book 6A (ISBN 952-5216-06-03), 1969, in chapter 6, section 3.2 "*Chip metering and feeding into process pressure*", on pages A522-A514. However, these rotary pocket feeders, especially the chip meter, have had either a circular inlet or have been fed by a screw conveyer from the chip bin, and thus have had no impact on an uniform retention time of chips in the chip bin.

SUMMARY OF THE INVENTION

An object of the invention is to solve the above-mentioned problems with an invention as in the appended claims. The solution is not related to the chip bin per se only or to rotary pocket feeders per se in the outlet, but instead to a combination of a simple and yet reliable chip bin and a rotary pocket feeder at outlet end that supports even flow from the whole arrangement of chip bin and rotary pocket feeder.

The advantages are that a better uniform material flow than in prior art is provided, where the same flow speed in the entire volume of material kept in the bin will be obtained with much decreased risk of stagnant zones, arches etc. Further, the total height of the bin and rotary pocket feeder may be lower than in prior art, which is cheaper.

If there is a wish for treatment in the bin, this invention also enables to have a better defined treatment time in a part of the bin, since all the material will spend the same time in said part of the bin. This gives a better result and is cheaper, since the treatment needs to take place in only a limited part of the bin.

With a rotary pocket feeder at the outlet, there are further advantages, such as an even more uniform material flow through the whole outlet, which flow is not sensitive to different conditions. A rotary pocket feeder treats the material more gently than e.g. a screw conveyor. The energy consumption is also lower.

Since the flow through a rotary pocket feeder is more well defined than the flow through e.g. a screw conveyor, it is also possible to use the rotary feeder for another function, namely for measuring the flow of the material. This obviates the need for a separate means for measuring the flow of the material.

The invention relates to a bin arrangement, i.e. a novel combination of a bin design and a rotatry pocket feeder that provide even flow of material through and from the arrangement.

The bin arrangement is intended for collecting and discharging of smaller ligno-cellulosic material, which bin comprises a cylindrical upper part with an inlet, and a conical lower part with an outlet, which conical lower part comprises a circular upper edge, an essentially rectangular shaped lower edge having two first opposing long sides and two second opposing short sides, and a surface between the upper edge and the lower edge. The bin arrangement is designed such that the opening formed in the lower edge forms a rectangular shape with a ratio of the first long sides to the second short sides in the range of 1.5-4:1, preferably 3:1, and directly below the lower edge is a rotary pocket feeder mounted with an inlet of the rotary pocket feeder having a form congruent to the rectangular shape of the lower edge and an outlet of the rotary pocket feeder on the opposite side of the rotary pocket feeder also having a form congruent to the rectangular shape of the lower edge, said rotary pocket feeder including at least one rotating feeder means with a rotating axis arranged between the rotary pocket feeder inlet and outlet and driven by a motor, with the axis extending in parallel with the first long sides, and with radially open pockets separated by at least 6 vanes on said axis, each vane running from one end of the axis to the other end of the axis and between the second short sides.

This design of bin and rotary pocket feeder in combination guarantees a uniform flow of material trough the arrangement while using a simple form of chip bin with less welding work for manufacturing.

In a preferred embodiment the bin arrangement has a rotary pocket feeder including two counter rotating feeder means with vanes arranged to rotate the feeder means so that the material is fed downwards in the pockets of the feeder means and in the middle of the two counter rotating feeder means.

Preferably the vanes of the rotary feeder are straight along the axis of the rotating feeder means, or alternatively are axially turned around the axis of the rotating feeder means. When using turned vanes, the vanes are turned so that a first end of a first vane and a second end of a second vane is along a line parallel to the axis of the rotating feeder means. These vanes provide a disturbance against the overlying material volume and helps filling of the pockets, and the turned vanes provide for a disturbance that travels from one end of rotor to the other during rotation.

The bin as such in the bin arrangement has a length of both the first long sides and the second short sides of the essentially rectangular lower edge that are shorter than the diameter of the upper edge. A transition from a large circular bin volume is thus possible.

Further the surface forming the outer wall of the bin in the transition part comprises two first opposing segments, each first opposing segment being between the upper edge and one of the first long sides of the lower edge; two second opposing segments, each second opposing segment being between the upper edge and one of the short second sides of the lower edge; and four intermediate segments, each of the intermediate segments between the upper edge, the lower edge, one of the first opposing segments and one of second opposing segments. Thus the entire concial transition part is made from only 8 wall segments, and could be welded together by only 8 welding seams. Further, each of the two first opposing segments is flat and essentially triangular with a base of the triangle towards one of the first long sides of the essentially rectangular lower edge. These segments becomes where easy to manufacture. Preferably each of the two first opposing segments has a first angle ($\alpha$1) of 1-10°, preferably 4-7°, to a thought vertical line. This part of the transition provides for a smaller degree of convergence towards the outlet, different from the convergence of the other parts of the transition.

Hence, in other parts of the transition the two second opposing segments is flat and essentially triangular with a base of the triangle towards one of the second short sides of the essentially rectangular lower edge. These segments becomes where easy to manufacture as well. Preferably each of the two second opposing segments has a second angle ($\alpha$2) of 5-20°, preferably 10-14° to a thought vertical line (32). This part of the transition provides for a larger degree of convergence towards the outlet, different from the convergence of the other parts of the transition.

Preferably the essentially rectangular lower edge has rounded corners. Sharp corners should be avoided as they may cause disturbance in flow.

Finally the four intermediate segments needed for the transition part are curved, and the conical transition may be manufactured by only 4 curved segments.

Further advantageous embodiments of the device according to the present invention and further advantages with the present invention emerge from the detailed description of embodiments.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
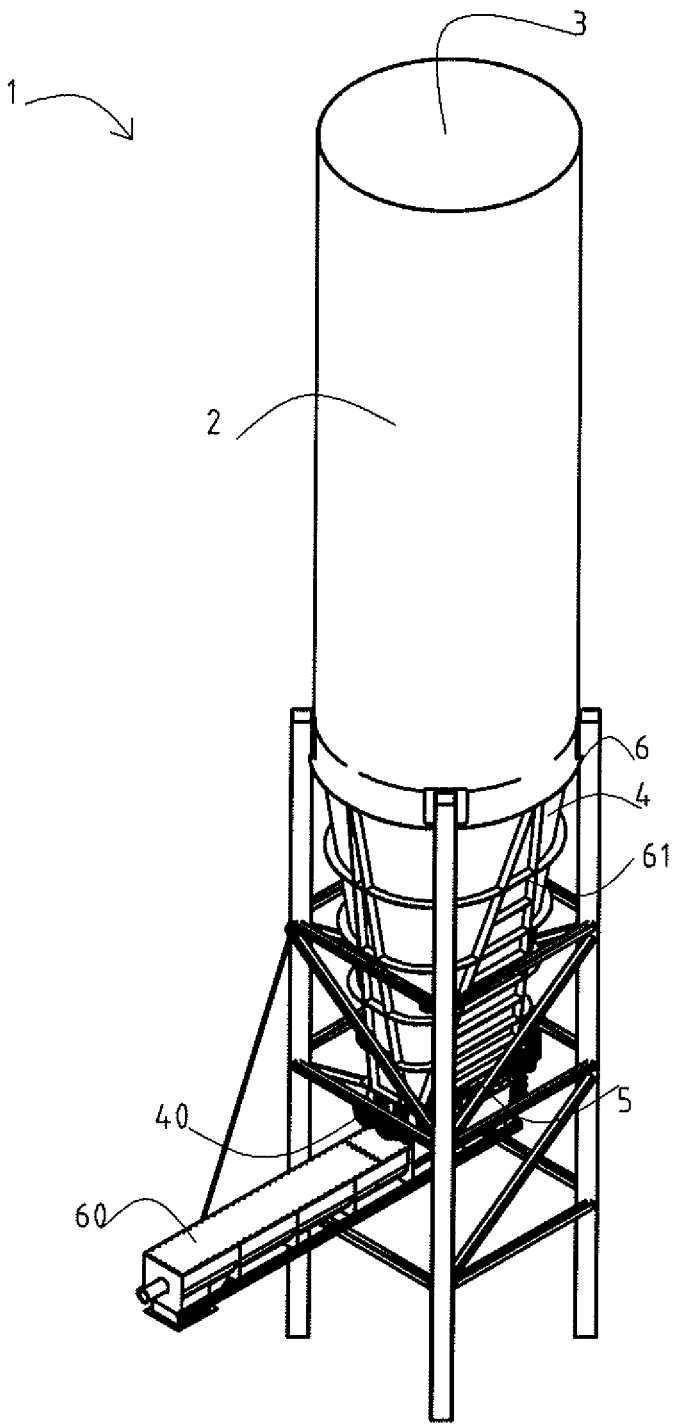
FIG. 1 is a perspective view of a bin arrangement according to the present invention.
Figure 2A:
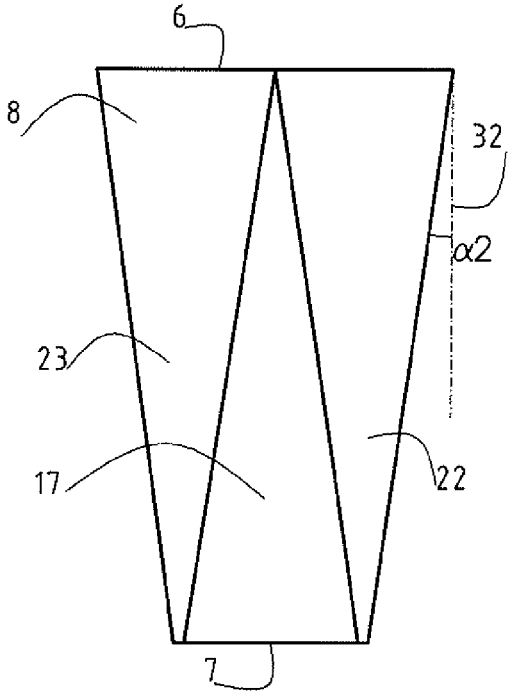
FIG. 2*a-d* are different views of the bin as such, i.e. two side views, a top view and a perspective view of the bin.
Figure 2B:
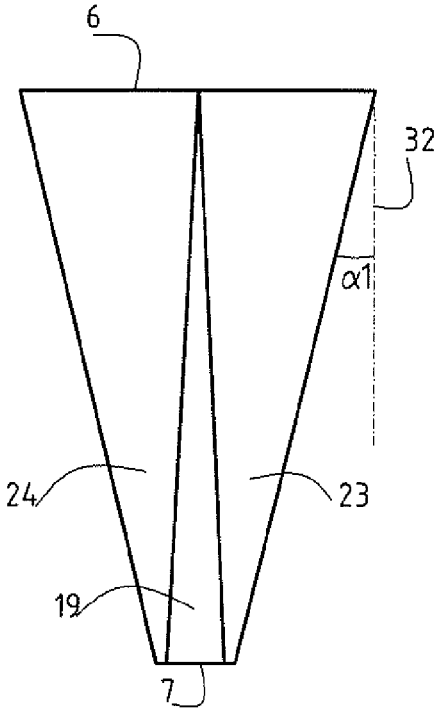
Figure 2C:
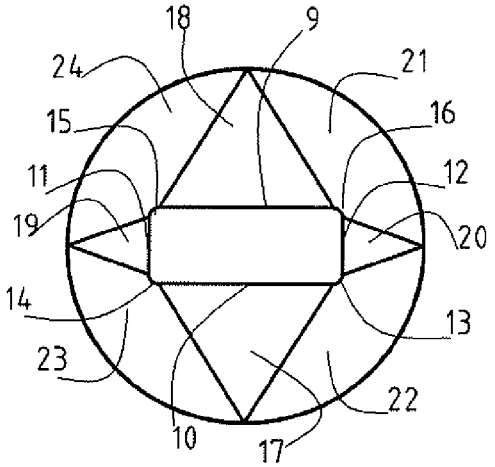
Figure 2D:
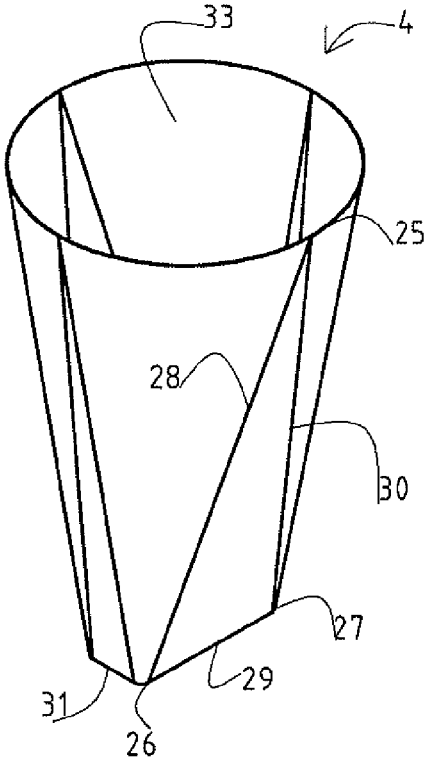
Figure 3A:
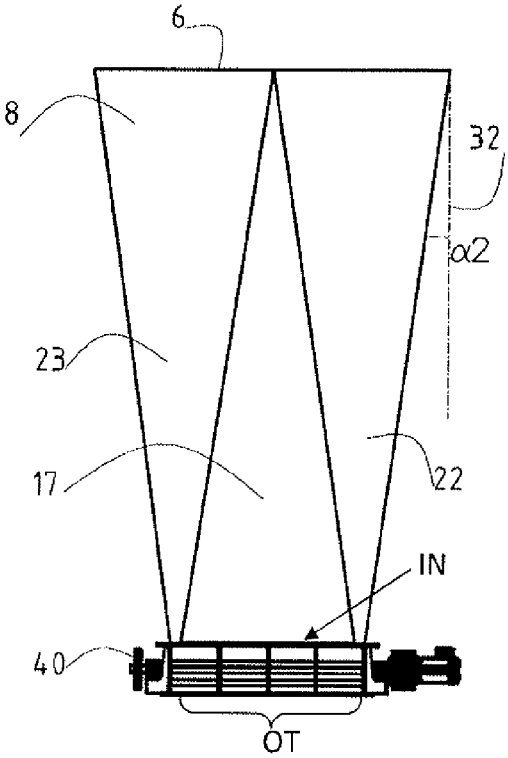
FIG. 3*a-d* are the same as FIG. 2*a-d*, but with feeder means in the form of a rotary pocket feeder.
Figure 3B:
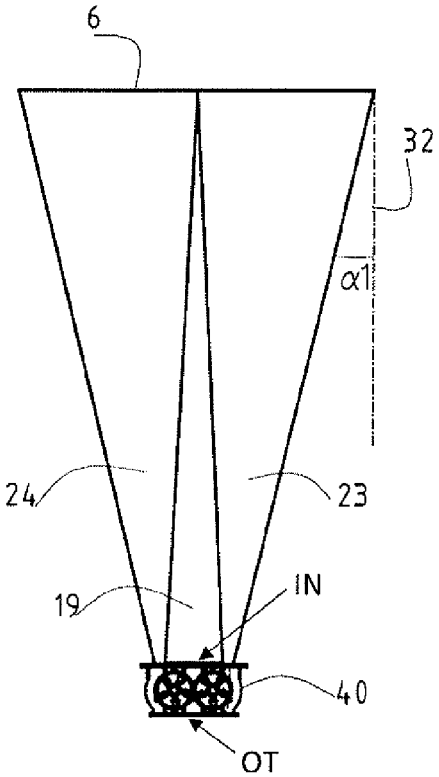
Figure 3C:
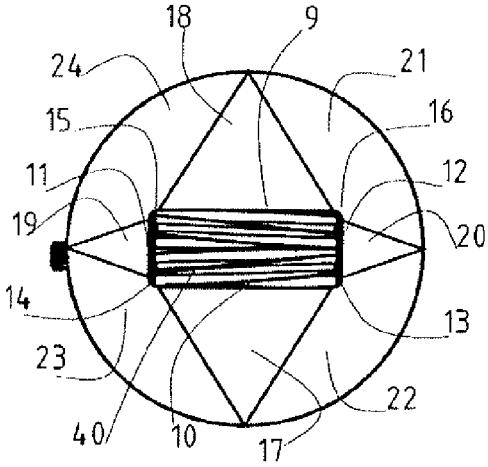
Figure 3D:
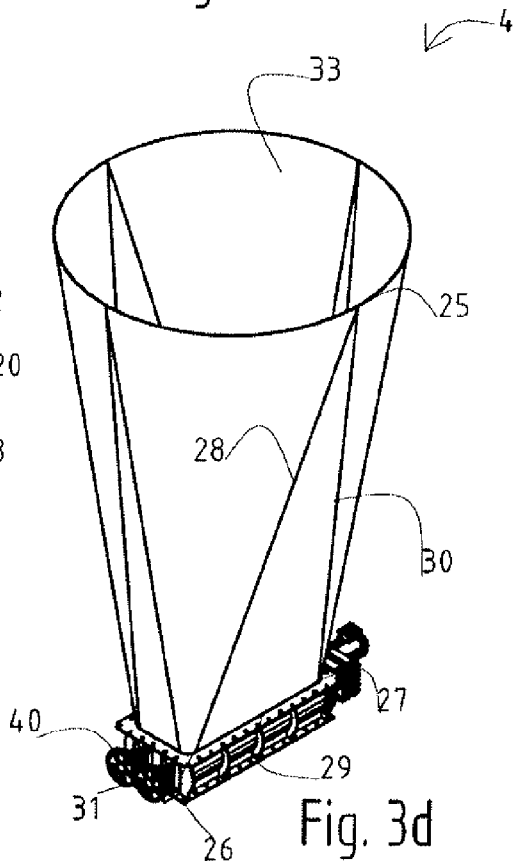

FIG. 1 illustrates an embodiment of a bin arrangement 1, according to the invention, for the collecting and discharging of smaller ligno-cellulosic material, preferably in the form of chips. The bin 1 comprises a cylindrical upper part 2 with an inlet 3 and a conical lower part 4 with an outlet 5. The inlet 3 and the outlet 5 should preferably be centred with respect to the bin 1. The bin 1 is provided with a rotary pocket feeder 40 at the outlet 5, which will be discussed below.

The bin 1 may also be provided with e.g. a screw conveyor 60 for further distribution of the material. This kind of screw conveyer is typically "starve-fed", meaning that the volumetric feed capacity of the screw conveyer is larger than the volumetric in feed of material. During operation this is easily implemented by increasing the speed of the screw conveyer. In this way is comminuted material not prevented from flowing through the rotary pocket feeder. However, the rotary pocket feeder could also feed the material straight downwardly to a chute. Further, the bin 1 may be provided with some kind of support 61.

It has been realised that in order to obtain a uniform mass flow in a bin, the added compressive stresses should be of such a size and distribution that the resulting shearing stress exceeds the strength of the material. The size of the compressive stresses is proportional to the diameter of the bin. The distribution of the compressive stresses depends much on the shape of the conical part. Simplified, in a conical part, which is symmetrical in all directions, compressive stresses will arise in all directions, while in a conical part as in FIG. 1, which is not symmetrical in all directions, compressive stresses will arise from two directions, which also results in a larger shearing stress, which results in that the material flows better through the bin.

The details of the conical lower part 4 are shown more in detail in FIG. 2*a-d*. In FIG. 3*a-d* is shown the same conical lower part 4, but with a rotary pocket feeder 40. The conical lower part 4 comprises a circular upper edge 6, an essentially rectangular shaped lower edge 7 and a surface 8 between the upper edge 6 and the lower edge 7. The circular upper edge 6 has the same diameter as the cylindrical upper part 2. The essentially rectangular shaped lower edge 7 has two first opposing long sides 9, 10 and two second opposing short sides 11, 12. "Essentially rectangular" means that the rectangle 7 may have straight or rounded sides 9, 10, 11, 12 and/or corners 13, 14, 15, 16. Preferably, the corners 13, 14, 15, 16 of the rectangle 7 are rounded, in order for the material not to get stuck in the corners 13, 14, 15, 16. Preferably, however, the sides 9, 10, 11, 12 are straight, for reasons explained below.

The surface 8 of the conical lower part 4 comprises two first opposing segments 17, 18, two second opposing segments 19, 20 and four intermediate segments 21, 22, 23, 24. Each first opposing segment 17, 18 is arranged between the upper edge 6 and one of the first long sides 9, 10 of the lower edge 7. Preferably, each of the two first opposing segments 17, 18 is flat and essentially triangular with a base 29 of the triangle towards one of the first long sides 9, 10 of the essentially rectangular lower edge 7. "Essentially triangular" means that the corners 25, 26, 27 and/or the sides 28, 29, 30 of the triangle 17, 18 may be straight or rounded, but, preferably, the sides 28, 29, 30 and the corners 25, 26, 27 of the triangle 17, 18 are straight, since that will give cheaper manufacture. Flat opposing segments 17, 18 will also cause a better flow, since there will be only one direction of stress in the flow.

In a corresponding way, each second opposing segment 19, 20 is arranged between the upper edge 6 and one of the second short sides 11, 12 of the lower edge 7. Preferably, each of the two second opposing segments 19, 20 is flat and essentially triangular with a base 31 of the triangle 19, 20 towards one of the second short sides 11, 12 of the essentially rectangular lower edge 7.

Each of the intermediate segments 21, 22, 23, 24 is arranged between the upper edge 6, the lower edge 7, one of the first opposing segments 17, 18 and one of second opposing segments 19, 20. Preferably, the intermediate segments 21, 23, 24 are curved so that a smooth surface 8 is created between the circular upper edge 6 and the essentially rectangular lower edge 7.

The length of both the first long sides 9, 10 and the second short sides 11, 12 of the essentially rectangular lower edge 7 should be shorter than the diameter of the circular upper edge 6.

An arrangement of this kind will give smooth borderlines between the different segments, which also will improve the mass flow through the bin.

Preferably, each of the two first opposing segments 17, 18 has a first angle $\alpha 1$ of 1-10°, 4-7°, to a thought vertical line 32, while each of the two second opposing segments 29, 20 has a second angle $\alpha 2$ of 5-20°, preferably 10-14° to the thought vertical line 32. This gives an essentially rectangular shape of the lower edge 7 with a ratio of the first side 9, 10 to the second side 11, 12 of about 1.5-4:1, preferably 3:1.

In order to give a uniform flow with the least risk of arching or ratholing, small first angles $\alpha 1$ and second angles $\alpha 2$ towards a thought vertical line 32 are better than large angles $\alpha 1$, $\alpha 2$. Also, having a lower edge 7 with a large cross section area is better than a lower edge 7 with a small cross section area. But, on the other hand, it is wished to have a uniform flow through the whole cross section of the lower edge 7, which is more difficult to obtain the larger the lower edge 7 is. Further, long cross sections in the conical lower part 4 are better than e.g. circular or square cross sections. But a long lower edge also requires a more expense feeder means. Thus, these are conditions that need weighing up towards each other.

Preferably, the first opposing segments 17, 18 and the second opposing segments 19, 20 do not meet on the lower edge 7, but the intermediate segment 21, 22, 23, 24 is intermediate also on the lower edge 7, thus shaping round corners 13, 14, 15, 16 of the lower edge 7.

For an optimal flow, the friction of the inner wall 33 in the conical part 4 should preferably be as low as possible. E.g. stainless steel will work. The friction of the inner wall in the cylindrical part 2 is less critical and may be higher.

Not only the shape of the bin 1, but also the rotary pocket feeder 40 for discharging the material affects the result. In order to have a uniform flow of the material, the rotary pocket feeder 40 should preferably feed the material uniformly from the whole cross section of the lower edge 7 or there is a risk that stagnant zones will occur. In the simplest form of the invention could the rotary pocket feeder include only one rotating feeder means. In the preferred embodiment disclosed in drawings the rotary pocket feeder 40 comprises two rotating means 41, 42, see FIG. 4*a-h*. It is an advantage to have two rotating means 41, 42 that are counter rotating, because the symmetry will increase the probability for a uniform feeding of the material from the whole cross section of the lower edge 7.

The opening formed in the lower edge of the bin forms a rectangular shape with a ratio of the first long sides 9, 10 to the second short sides 11, 12 in the range of 1.5-4:1, preferably 3:1, and directly below the lower edge is a rotary pocket feeder 40 mounted with an inlet IN of the rotary pocket feeder having a form congruent to the rectangular shape of the lower edge 7 and an outlet OT of the rotary pocket feeder on the opposite side of the rotary pocket feeder also having a form congruent to the rectangular shape of the lower edge.

In FIG. 4*a-h* is shown a better solution which will be less sensitive for different conditions. There is shown a rotary pocket feeder 40 having two rotating means 41, 42 in the form of rotary feeder parts 41, 42 with horizontal and parallel axes 43. The rotary pocket feeder 40 is also provided with a motor 48.

Preferably, the rotary pocket feeder 40 has counter rotating rotary feeder parts 41, 42 and is arranged to feed the material downwards through the vanes 44, 45. The best result is given if the counter rotating feeder parts 41, 42 rotates so that the material is fed downwards in the middle of the rotary pocket feeder 40, between the feeder parts 41, 42. It would, however, also work, but not as well, to instead feed the material downwards at the peripheries of the rotary pocket feeder 40. The rotary feeder parts 41, 42 should preferably be synchronized, so that they rotate with the same speed, but in opposite directions. This may e.g. be achieved with two motors that are e.g. electronically synchronized, or, as in FIG. 4*a-h*, having gears 51, 52.

There are preferably 6-12 vanes 44, 45, 49, 50 in each rotary feeder part 41, 42. The vanes form radially open pockets separated by the vanes on the rotary feeder part, each vane running from one end of the axis to the other end of the axis and between the second short sides 11,12.

Figure 4A:
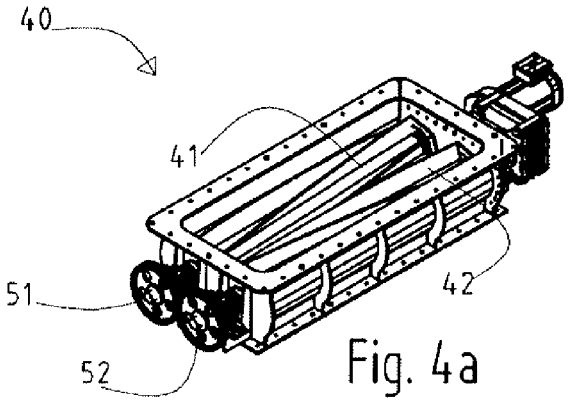
FIG. 4*a-f* are a perspective view, three side views, a cross section view and a top view of a rotary pocket feeder according to the present invention.
Figure 4B:
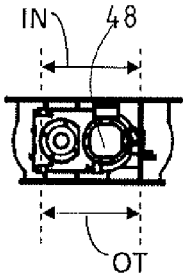
Figure 4C:
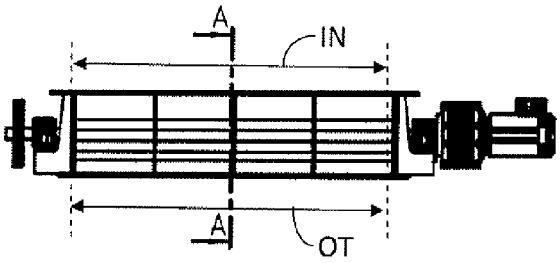
Figure 4D:
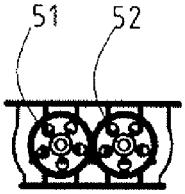
Figure 4E:
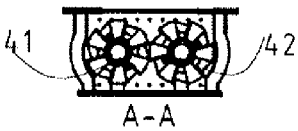
Figure 4F:
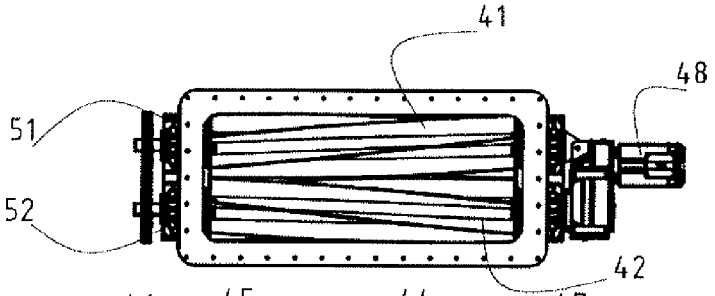
Figure 4G:
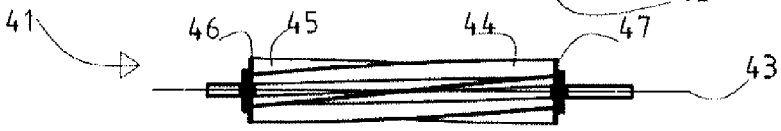
FIG. 4*g-h* are different side views of different embodiments of a rotary feeder part with straight and turned vanes, respectively.
Figure 4H:
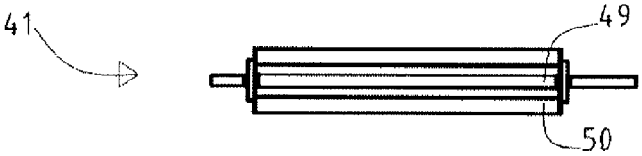

In order to feed the material uniformly from the whole cross section of the lower edge 7, the vanes 44, 45 are preferably axially turned around the axis 43 as in FIG. 4*h*, but the vanes 49, 50 may also be straight as in FIG. 4*g*. Best result seems to be given by having a first end 46 of a first vane 44 and a second end 47 of a second vane 45 being along a line parallel to the axis of the rotating means 41, 42. Preferably, the first vane 44 and second vane 45 are subsequent vanes 44, 45. This may also be explained as each vane 44, 45 is turned around the axis 1/N of a turn, where N is the number of vanes 44, 45.

A rotary pocket feeder also treats the material more gently than a screw conveyor. Since the flow through a rotary pocket feeder is more well defined than the flow through a screw, it is also possible to use the rotary pocket feeder for another function, namely for measuring the flow of the material. This obviates the need for a separate means for measuring the flow of the material.

Having also second opposing segments 19, 20 enables to have a lower bin 1, which is cheaper. It also enables a better control of the flow through the bin 1. It further means that the rotary pocket feeder means 40 need not be so long, which is economical. It also enables to have a standardised size of the lower edge 7, so that the same rotary pocket feeder 40 may be used for a number of bins 1 having different diameters of the upper edge 6, which also is economical. In total, the costs both for manufacture and installation will be considerably lower than in prior art.

Further, since this arrangement will make the mass flow through the bin much more uniform, the retention time of the material in the bin and also in different part of the bin will be much better defined. If there is a wish for treatment in the bin, this invention also enables to have a better defined treatment time in a part of the bin, since all the material will spend the same time in said part of the bin. This means that the bin may have e.g. alkali treatment in only a limited part of the bin and thus operate with a cold top of the bin, which is very economical. The invention shall not be considered limited to the embodiments illustrated, but can be modified and altered in many ways by one skilled in the art, without departing from the scope of the appended claims.

While the present invention has been described in accordance with preferred compositions and embodiments, it is to be understood that certain substitutions and alterations may be made thereto without departing from the spirit and scope of the following claims.

The invention claimed is:

1. A bin arrangement for collecting and discharging of wood chips, comprising:

a cylindrical upper part having a cylindrical upper part inlet defined therein, and a conical lower part having a conical lower part outlet defined therein, the conical lower part comprising a circular upper edge, an essentially rectangular shaped lower edge having two first opposing long sides and two second opposing short sides;

the conical lower part having a first and a second triangular shaped segment extending from the circular upper edge to the rectangular lower edge, the first triangular shaped segment being substantially congruent with and disposed opposite to the second triangular shaped segment;

a first, second, third and fourth curved segment extending from the circular upper edge to the rectangular lower edge, the first curved segment being substantially congruent with and disposed opposite to the fourth curved segment, the second curved segment being substantially congruent with and disposed opposite to the third curved segment, the first and fourth curved segments being different from the second and third curved segments, the first triangular shaped segment being disposed between the first and second curved segments and the second triangular shaped segment being disposed between the third and fourth curved segments;

a third and a fourth isosceles triangular shaped segment each extending from the circular upper edge to the rectangular lower edge, the third triangular shaped segment being substantially congruent with and disposed opposite to the fourth triangular shaped segment, the third triangular shaped segment being disposed between the first curved segment and the third curved segment, the fourth triangular shaped segment being disposed between the second curved segment and the fourth curved segment;

the lower edge having an opening formed therein, the opening having a rectangular shape with a ratio of the first long sides to the second short sides being in a range of 1.5-4:1;

a rotary pocket feeder being mounted directly below the lower edge, the rotary pocket feeding having an inlet (IN) and an outlet (OT) defined therein, the inlet (IN) having a form congruent to the essentially rectangular shape of the lower edge and the outlet (OT) of the rotary pocket feeder on an opposite side of the rotary pocket feeder also having a form congruent to the essentially rectangular shape of the lower edge;

the rotary pocket feeder having two counter rotating feeder means for feeding the chips, the two counter rotating feeder means having vanes arranged to rotate the two counter rotating feeder means so that the chips are fed downwardly into pockets of the two counter rotating feeder means and into a middle of the two counter rotating feeder means, each counter rotating feeder means having a rotating axis arranged between the inlet (IN) and the outlet (OT) of the rotary pocket feeder and driven by a motor, the rotating axis extending in a direction that is parallel to the first long sides, and to radially open pockets separated by at least 6 vanes on the rotating axis, each vane running from one end of the rotating axis to another end of the rotating axis and between the second short sides; and the conical lower part outlet being centrally located relative to the circular upper edge and the cylindrical upper part inlet.

2. The bin arrangement according to claim 1 wherein the vanes of the rotary pocket feeder are straight along the rotating axis of the two counter rotating feeder means.

3. The bin arrangement according to claim 1 wherein the vanes of the rotary pocket feeder are axially turned around the rotating axis of the two counter rotating feeder means.

4. The bin arrangement according to claim 3 wherein the vanes are turned so that a first end of a first vane and a second end of a second vane are disposed along a line parallel to the rotating axis of the two counter rotating feeder means.

5. The bin arrangement according to claim 1 wherein lengths of both the first lona sides and the second short sides of the essentially rectangular lower edge are shorter than a diameter of the upper edge; and the surface comprises:

two first opposing segments, each first opposing segment being disposed between the upper edge and one of the first long sides of the lower edge; two second opposing segments, each second opposing segment being disposed between the upper edge and one of the short second sides of the lower edge; and four intermediate segments, each of the intermediate segments being disposed between the upper edge, the lower edge, one of the first opposing segments and one of second opposing segments.

6. The bin arrangement according to claim 5 wherein each of the two first opposing segments is flat and essentially triangular having a base of a triangle towards one of the first long sides of the essentially rectangular lower edge.

7. The bin arrangement according to claim 6 wherein each of the two first opposing segments forms a first angle ($\alpha$1) of 1-10° relative to an imaginary vertical line extending downwardly in a vertical direction from the circular upper edge of the conical lower part.

8. The bin arrangement according to claim 7 wherein each of the two second opposing segments is flat and essentially triangular having a base of a triangle towards one of the second short sides of the essentially rectangular lower edge.

9. The bin arrangement according to claim 8 wherein each of the two second opposing segments forms a second angle ($\alpha$2) of 5-20°, relative to an imaginary vertical line extending downwardly in a vertical direction from the circular upper edge of the conical lower part.

10. The bin arrangement according to claims 9 wherein the essentially rectangular lower edge has rounded corners.

11. The bin arrangement according to claim 10 wherein four intermediate segments are curved.

* * * * *